United States Patent [19]

Turley et al.

[11] Patent Number: 4,462,236

[45] Date of Patent: Jul. 31, 1984

[54] FOURTEEN-HIGH ROLLING MILL

[75] Inventors: John W. Turley, Oxford; Michael G. Sendzimir, Woodbury, both of Conn.

[73] Assignee: T. Sendzimir, Inc., Waterbury, Conn.

[21] Appl. No.: 362,459

[22] Filed: Mar. 26, 1982

[51] Int. Cl.[3] ..... B21B 29/00; B21B 31/16

[52] U.S. Cl. ..... 72/242; 72/243; 72/245

[58] Field of Search ..... 72/241, 242, 243, 245, 72/238, 239

[56] References Cited

U.S. PATENT DOCUMENTS 3,695,082 10/1972 Leifeld et al. ..... 72/243
4,064,728 12/1977 Dobrovolsky ..... 72/238
4,270,377 6/1981 Verbickas et al. ..... 72/242

FOREIGN PATENT DOCUMENTS 56-59514 5/1981 Japan ..... 72/243
56-59517 5/1981 Japan ..... 72/243
0522866 7/1976 U.S.S.R. ..... 72/243

*Primary Examiner*—Francis S. Husar
*Assistant Examiner*—Steven B. Katz
*Attorney, Agent, or Firm*—Frost & Jacobs

[57] ABSTRACT

A new rolling mill configuration is provided containing fourteen rolls and which may be described as an improved six-high arrangement. The mill contains two substantially identical upper and lower roll clusters. Each roll cluster comprises a floating work roll, a chock mounted intermediate roll and a chock mounted backup roll. The work roll is supported laterally by a pair of chock mounted side intermediate rolls and each side intermediate roll is supported by a single side backing roller assembly. The chocks of each side intermediate roll and the adjacent side backing roller assembly are supported by an adjustable stationary rigid support beam assembly.

7 Claims, 9 Drawing Figures

FIG. 1 - PRIOR ART

FOURTEEN-HIGH ROLLING MILL

CROSS REFERENCE TO RELATED APPLICATION AND PATENT

This application is related to co-pending application Ser. No. 06/362,460 filed Mar. 26, 1982, in the names of John W. Turley and Michael G. Sendzimir and entitled Improvements to Six-High Rolling Mills, and to U.S. Pat. No. 4,270,377.

BACKGROUND OF THE INVENTION

The object of this invention is to provide an improved type of six-high (1-1-1) rolling mill in which additional rolls and bearings are provided in order to give lateral support for the work rolls, thus enabling smaller work rolls to be used than would be the case of a six-high rolling mill without such lateral support.

Such a mill was first proposed by Murakami (U.S. Pat. No. 2,907,235) to our knowledge. In the Murakami mill, each work roll was provided with a lateral support at each side (i.e. entry and exit sides), each lateral support comprising a set of rollers mounted upon a common shaft, the shaft being supported at intervals throughout its length by saddles, the saddles themselves being supported by a rigid frame attached to the mill housings. This structure suffered from the fact that due to the intermittent support of the work roll by the rollers, wear on the work roll was uneven, and so a striping of the work roll would occur, the stripes corresponding to the positions of the lateral support rollers. This striping would then transfer to the rolled product, thus causing unacceptable surface finish.

In U.S. Pat. No. 4,270,377, the teachings of which are incorporated herein by reference, it was taught that this defeat could be overcome by providing side support clusters on each side of each work roll, the clusters each comprising a side support roll which supports the work roll and is itself supported at intervals throughout its length by two sets of rollers, each of the sets of rollers being supported on a common shaft, each shaft being supported at intervals throughout its length by saddles, the saddles being supported in turn by a side support beam assembly attached to the mill housings. This mill also offered the advantage of high reduction capability and superior performance to other types of rolling mills.

BRIEF SUMMARY OF THE INVENTION

The present invention consists of a new cluster mill arrangement which provides the same performance advantages and freedom from striping as the mill of U.S. Pat. No. 4,270,377, but with a simpler and less expensive configuration.

DETAILED DESCRIPTION

Figure 2:
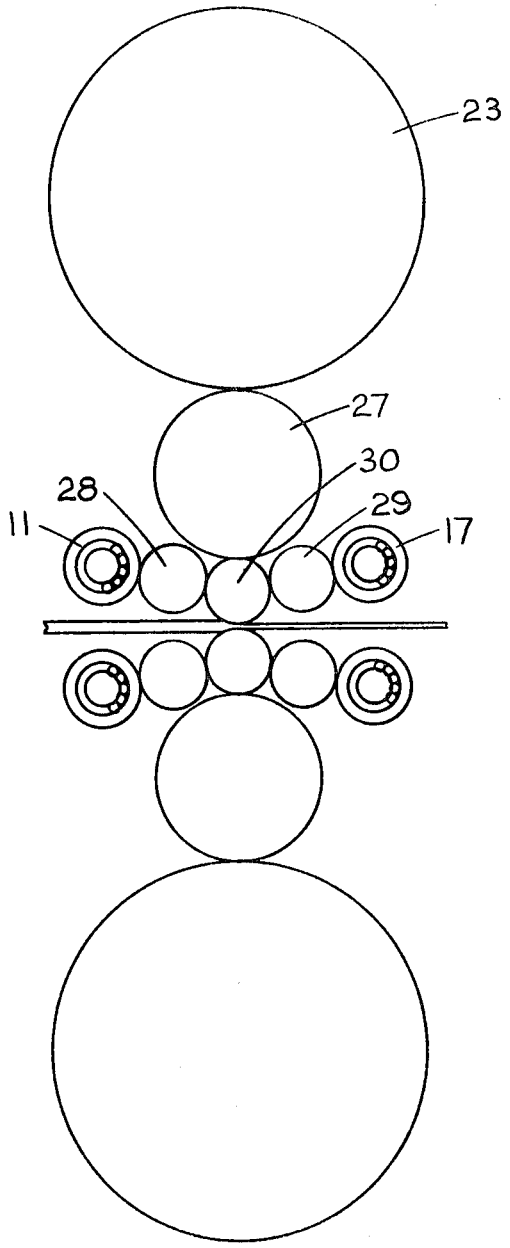
FIG. 2 shows in diagrammatic form the mill geometry according to the present invention.

The basic fourteen-high arrangement of FIG. 2 contains two clusters, each of which comprise a work roll 30 supported vertically by intermediate roll 27 and back-up roll 23, and laterally by side intermediate rolls 28 and 29, which in turn are supported by side backing rollers 11 and 17.

The general constructional features of the mill, apart from the design of the lateral support assemblies, are according to the prior art and may readily be understood from U.S. Pat. No. 4,270,377, the teachings of which are incorporated herein by reference.

Figure 1:
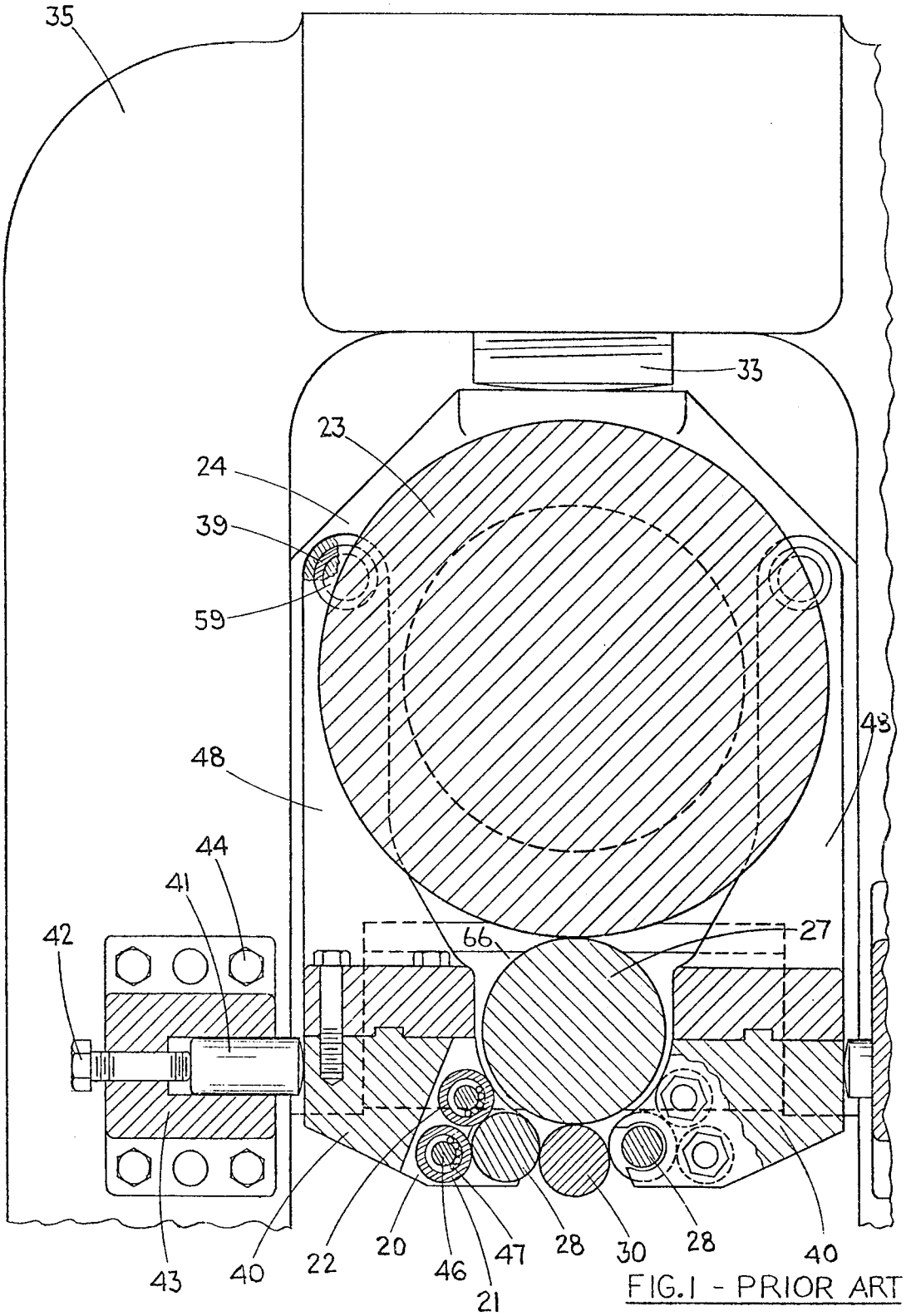
FIG. 1 is a fragmentary elevational view, partly in cross section, of the top half of a rolling mill according to the prior art.
Figure 3:
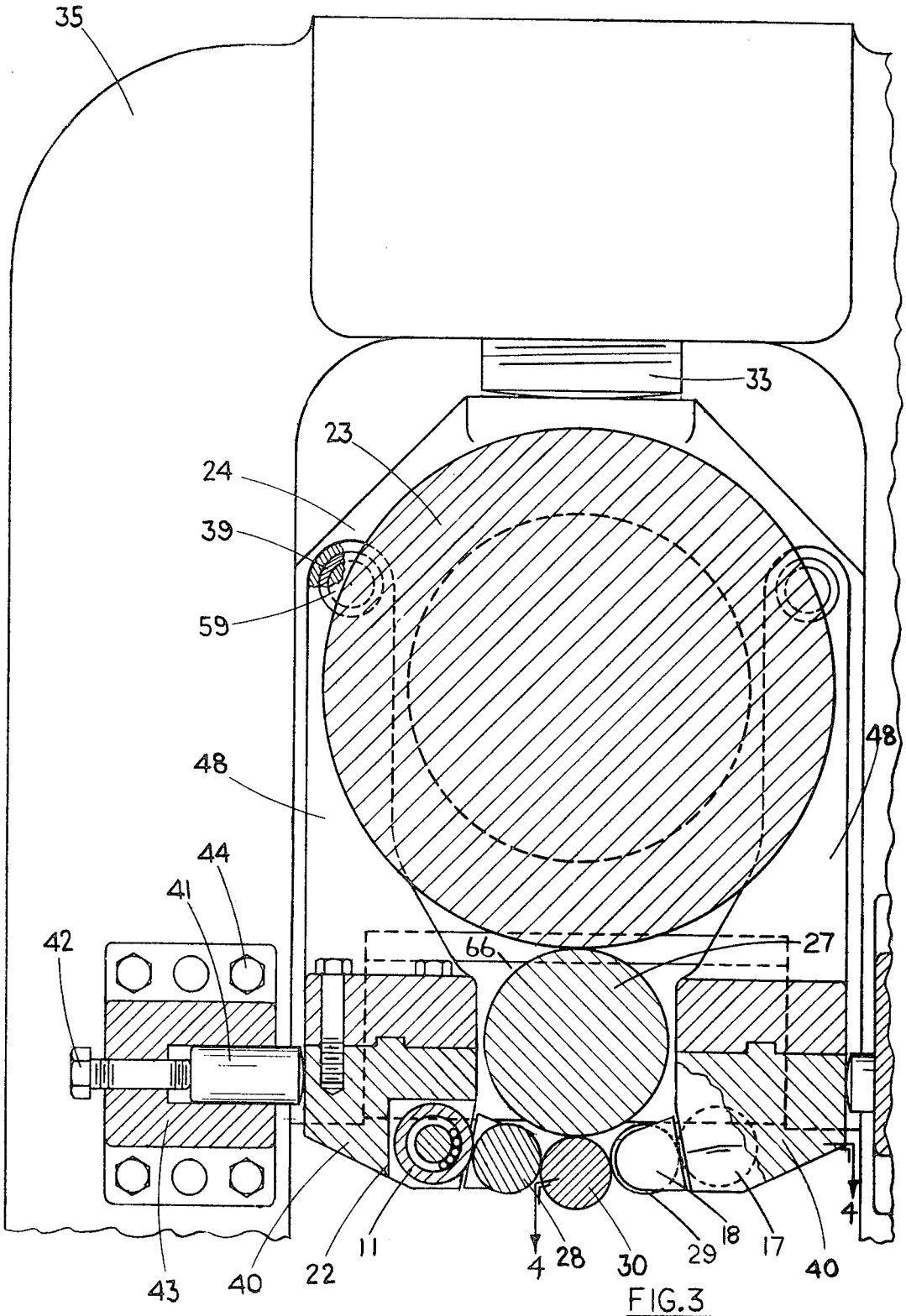
FIG. 3 is a fragmentary elevational view, partly in cross section, of the top half of one embodiment of the mill according to the present invention.

FIG. 1 shows the prior art arrangement of the upper half of one embodiment of the mill according to the above mentioned patent. In FIG. 3, the corresponding arrangement of an embodiment of the mill according to the present invention is shown, and like parts have been given like index numerals. By comparing FIG. 3 with FIG. 1, the difference between the present invention and the prior art can be clearly seen.

As seen in FIG. 3, each work roll 30 is not mounted in chocks, but floats freely in the stack as in cluster mills. The work roll is restrained from sideways movement by the side support rolls 28 and 29, which are themselves supported at intervals throughout their length by side backing rollers 11 and 17, respectively. The backing rollers 11 and 17 are mounted in side support beams 40 to which are attached arms 48 which are pivoted on the back-up roll chocks 24 by means of pivot pins 59 and bushings 39.

Figure 4:
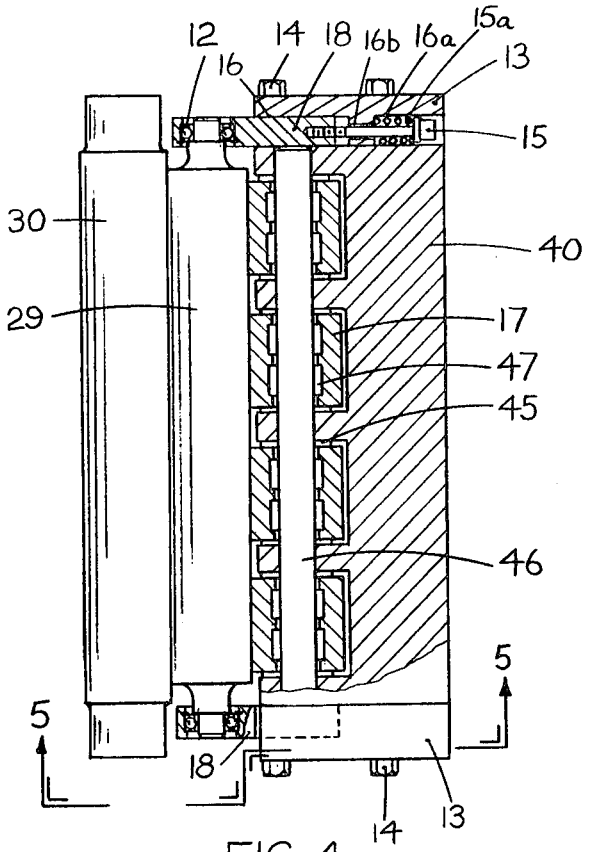
FIG. 4 is a cross-sectional plan view taken along the section line 4—4 of FIG. 3 showing the construction of the side intermediate rolls, chocks and guides.
Figure 5:
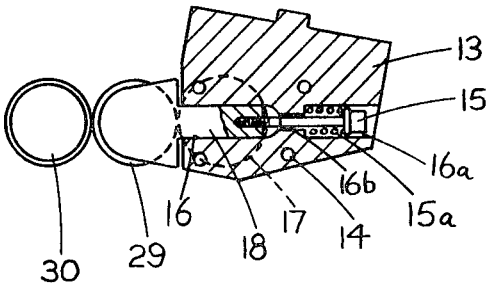
FIG. 5 is a partial cross sectional view taken along the section line 5—5 of FIG. 4 showing a side intermediate roll, chock and guide.

The construction of a side support beam 40 is shown in FIGS. 4 and 5. Side backing rollers 17 are rotatably mounted upon shaft 46 by means of needle rollers 47. The side backing rollers 17 are mounted within recesses in the side support beam 40 to which they are rotatably mounted by means of shaft 46. Spacer washers 45 are used to locate the side backing rollers centrally within the recesses in the side support beam 40. Shaft 46 is retained axially in the side support beam by means of end plates 13 which are attached to the side support beam by means of screws 14. The end plates 13 also provide slide mounting and guiding of side intermediate roll chocks 18.

Side intermediate roll 29 is mounted in chocks 18 by means of bearings 12. Each of the chocks slides in slot 16 formed in end plate 13. A second slot **16*a* is formed in end plate 13 and is connected to slot 16 by a bore 16*b*. A screw 15 and spring 15*a* are located in slot 16*a*. The screw shank extends through bore 16*b* and is threadedly engaged in chock 18. Spring 15*a* abuts the end of slot 16*a* and the head of screw 15. This adjustable screw-spring arrangement on both sides of support beam 40** enables both of the chocks 18 to be urged in such a direction as to maintain the side intermediate roll 29 firmly in contact with the side backing rollers 17 at all times. It will be understood that support beam 40 for side intermediate roll 29 and side backing rollers 11 is substantially identical to that just described.

It is understood in the art that all rolling mill rolls are subject to wear and must be reground from time to time to remove surface damage or wear marks that occur inevitably during rolling. In the case of the present invention, as the back-up rolls 23, intermediate rolls 27 and work rolls 30 wear, the direction of the force acting between each work roll and its adjacent side intermediate roll, i.e. the direction of the plane joining the respective axes of these rolls, changes. Therefore, the side support roll assemblies are so designed that the axes of the work roll 30, the side intermediate rolls 28 and 29, and the side backing rollers 11 and 17 all lie on the same plane, that is, "in line", when the diameters of work rolls 30, intermediate rolls 27 and back-up rolls 23 are at their respective average values, that is, mid-way between their respective values when new and their respective values when worn out. When the mill operates with average sized rolls, there is virtually no bending force on side intermediate rolls 28 and 29 since they are each loaded by work roll 30 along one generator, and the load is reacted by the side backing rollers 11 and 17 along the generator which is diametrically opposite the generator where the load is applied. This condition is shown in FIG. 3.

At other roll sizes, it is not possible to maintain this ideal "in line" condition. In these cases, there is a resultant force on each of the side intermediate rolls 28 and 29 (FIG. 3) which acts substantially at right angles to the direction of the load applied by work roll 30. This force acts downwards for roll sizes less than average (where the work roll axis is above the plane joining each side intermediate roll axis with its adjacent backing roller axis), and upwards for roll sizes greater than average (where the work roll axis is below the plane joining each side intermediate roll axis with its adjacent backing roller axis). In order to maintain each side intermediate roll in equilibrium, the resultant force must be reacted somewhere. The reaction force is in fact supplied by the side intermediate roll bearings 12 and chocks 18. Since the deflection of the side intermediate roll due to the resultant force is in the direction of the resultant force, that is, substantially at right angles to the load force P applied by the work roll, the effect of this deflection at the work roll is minimized but remains a limiting factor in the design.

As shown in the above mentioned co-pending application, the teachings of which are incorporated herein by reference, each side support beam 40 can be divided into three parts: firstly, a support arm in which said backing rollers are mounted, said support arm being pivotally mounted on the intermediate roll chocks; secondly, adjustment or spacer means to adjust the clearance between the side support roll assembly and the work roll; and, thirdly, a rigid beam mounted to the mill housings. Said rigid beam, according to said co-pending application, may also be provided with overload prevention means.

Figure 6:
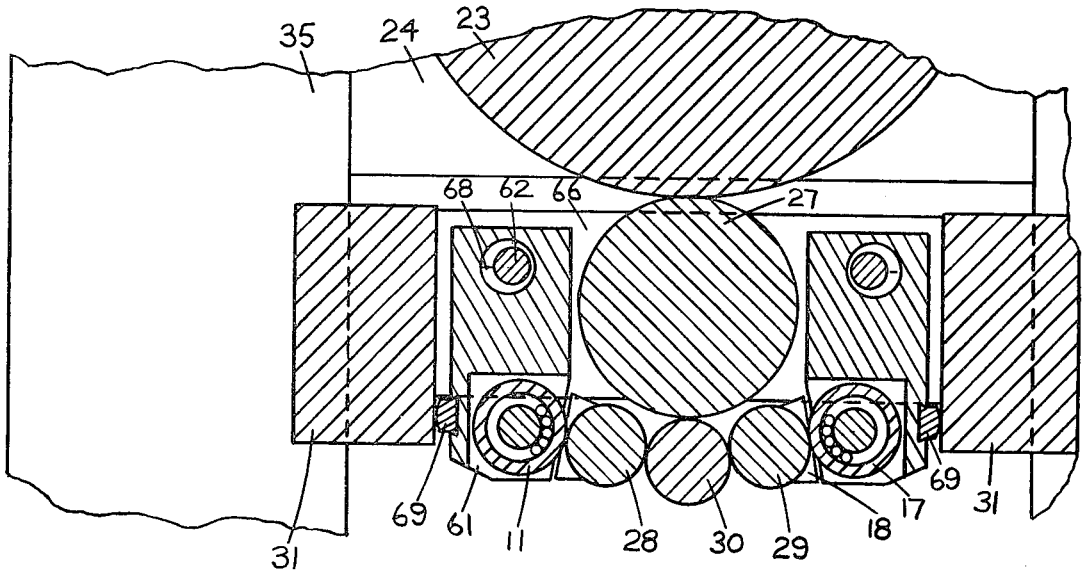
FIG. 6 is a fragmentary elevational view, partly in cross section, of the top half of the preferred embodiment of the mill according to the present invention.
Figure 7:
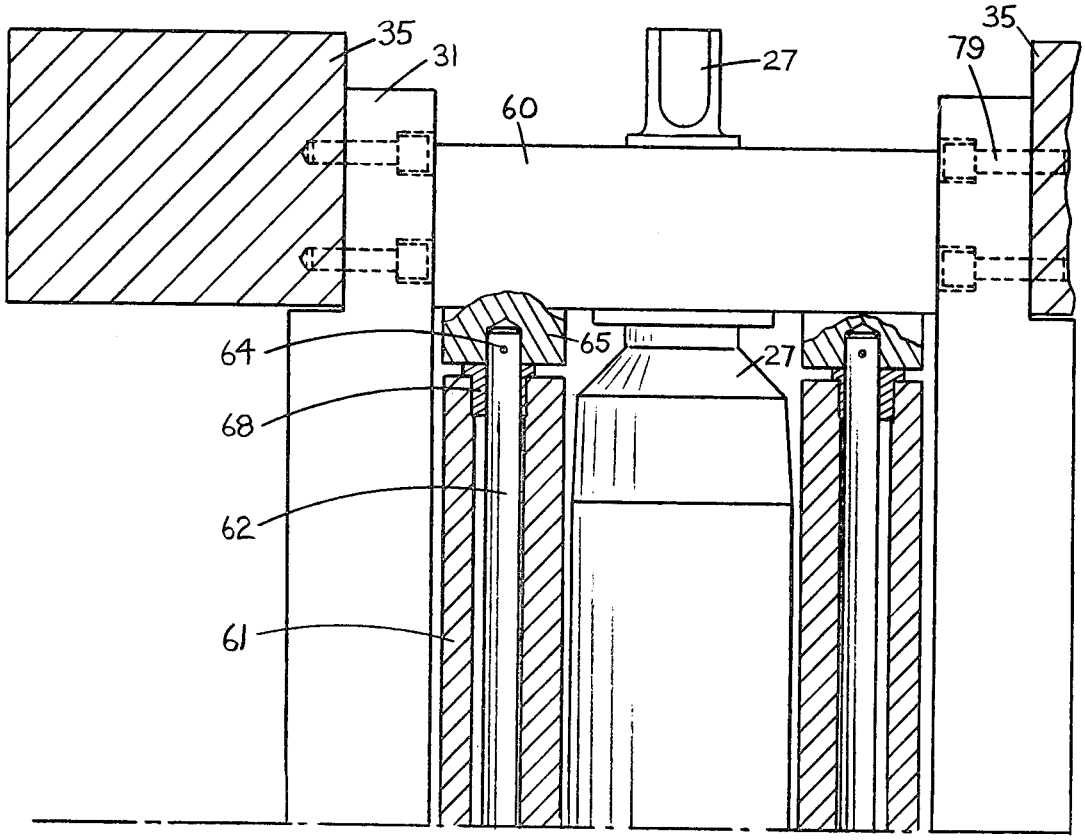
FIG. 7 is a fragmentary plan view, partly in cross section, of the structure of FIG. 6.
Figure 8:
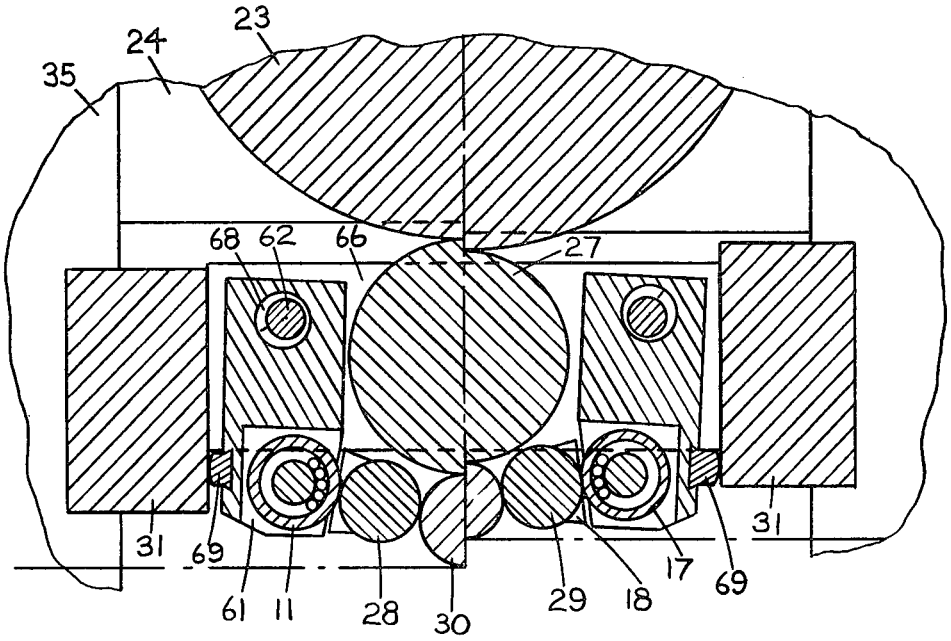
FIG. 8 is a fragmentary elevational view, partly in cross section, of the top half of the preferred embodiment of the mill showing maximum and minimum roll conditions.

The preferred construction for the present mill is shown in the embodiment of FIGS. 6 and 7. In this embodiment, which is based upon the side support beam construction of the above mentioned co-pending application, the side backing rollers 11 and 17 are mounted in support arms 61 which are pivotally mounted by means of pivot rods 62 and eccentric bushings 68 on lugs 65 which form part of intermediate roll chocks 60. Roll pins 64 retain the pivot rods in said lugs 65. Fixed stationary side support beams 31 span between mill housings 35 to which they are attached by screws 79. The lateral torque reaction force is thus transmitted to the housing via side intermediate roll 28 (or 29), side backing rollers 11 (or 17), support arm 61, spacer 69 and beam 31. Spacers 69 are retained in support arms 61 by dovetail slides and are easily changed. Several sets of spacers are provided and are selected according to the current work roll diameter in order to minimize clearances between side support rolls 28 or 29 and work rolls 30. This construction offers two advantages compared with the construction of FIG. 3 (in addition to the advantages of such construction disclosed in the above noted co-pending application). These are, firstly, that the positions of the lateral support assemblies relative to the work roll are unaffected by the diameter of the back-up roll and, secondly, that by enabling the placement of the pivot axis for each lateral support assembly much closer to the axes of the adjacent side intermediate roll and side backing rollers, then the support arm 61 will tilt according to the current size of the work roll to maintain the side intermediate roll axis closer to the plane joining the work roll axis and side support roller axis, i.e. closer to the "in line" condition, regardless of work roll and intermediate roll size. This reduces the resultant force tending to bend the side intermediate rolls and thus reduces the deflection of said side intermediate rolls. Furthermore, by rotating eccentric bushings 68, it is possible to adjust the position of the support arm to ensure that the side intermediate rolls and side backing rollers are "in line" with the work roll at all times, regardless of current work roll and intermediate roll sizes. In FIG. 8, the maximum size roll condition is shown on the left, and the minimum size roll condition is shown on the right. For both of these conditions, the "in line" condition is achieved as can be clearly seen. For the maximum size roll condition, it can be seen that eccentric bushing 68 is rotated so that its heavy side, identified on FIGS. 6 and 8 by an index mark, is facing in a downward direction. For the minimum size roll condition, the heavy side is facing in an upward direction. It is envisaged that eccentric bushings 68 would be adjusted according to a chart supplied by the mill designer whenever intermediate rolls were changed. Note that locking means, such as set screws or the like, would be provided for eccentric bushings 68 (to prevent further rotation after said adjustment is made), such means being omitted from the drawings for the sake of clarity. Note also in FIG. 8 that, for the maximum size roll condition shown on the left, relatively thin spacers 69 are selected. For the minimum size roll condition shown on the right, relatively thick spacers 69 are selected.

A further advantage of the present invention relative to U.S. Pat. No. 4,270,377 is that the present invention enables a higher load capacity to be achieved. In the case of FIG. 1, for example, rollers 21 are typically subjected to a force component of about 78% of the torque reaction force transferred from intermediate roll 27 to work roll 30, and rollers 22 are subjected to a component of about 35% of the torque reaction force. In the case of FIG. 3, side backing rollers 11 and 17 are subjected to virtually 100% of said torque reaction force. However, since rollers 11 and 17 are about 40% bigger than rollers 21 and 22 (for the same size work roll and intermediate roll), they have about 40% more load capacity. Hence, relative to rollers 21, their ratio of capacity to load is about 9% higher. Furthermore, as can be seen by comparison of FIGS. 2 and 3, there is much more room to increase the diameter of rollers 11 and 17 than there is to increase the diameter of rollers 21 and 22. Thus, the present invention enables a higher load capacity of the lateral support assemblies to be obtained.

Figure 9:
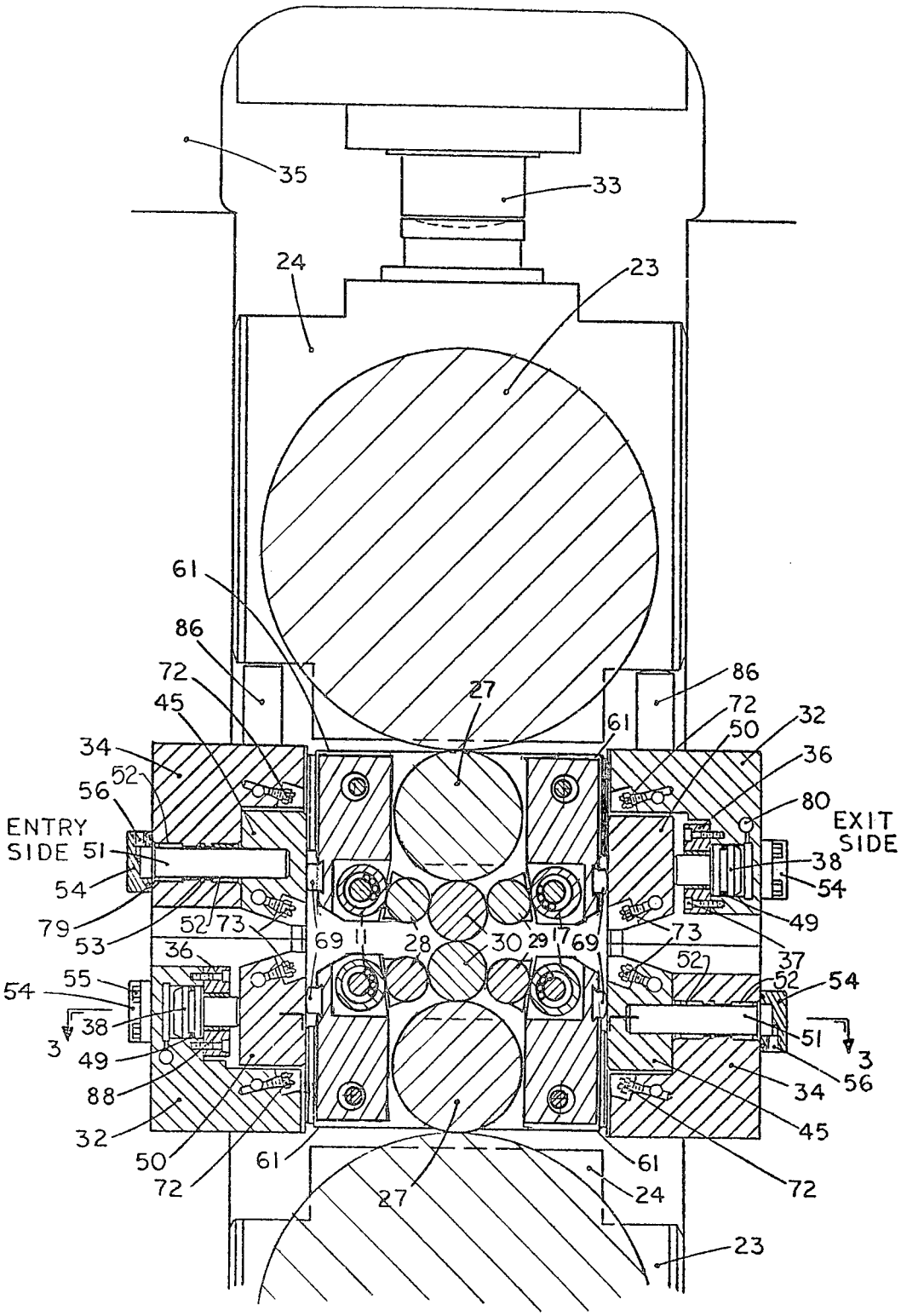
FIG. 9 is a fragmentary cross sectional view of another embodiment of the mill according to the present invention.

Another embodiment of the present invention is illustrated in FIG. 9. This embodiment is similar to that shown in FIGS. 6, 7 and 8 and like parts are given like index numerals. This embodiment differs from that of FIGS. 6, 7 and 8 in that fixed stationary side support beams 31 have been replaced by fixed side support beams 32 and 34 of the type taught in the above mentioned application in the name of the same inventors.

As shown in FIG. 9, fixed side support beams 34 are mounted at upper left and lower right, and fixed side support beams 32 are mounted on lower left and upper right. All four of these beams span between the mill housings (one of which is shown at 35) to which they are attached by screws (not shown). The beams are also each bored out in two places to provide for mounting of upper back-up roll balance cylinders 86.

Each beam 32 is recessed to provide space for movable beam 50, known as an overload beam, which is slideably mounted in beam 32 by means of guide pins 51 and bushings 52. The guide pins 51 are press fitted in the overload beam 50 and slide freely in the bushings 52. Each beam 32 is bored in a plurality of places to form cylinders which accommodate hydraulic pistons 38, which are retained in the beam by means of retainer plate 36, attached to the beam by screws 37. The hydraulic pistons are guided in the retainer plate by bushings 88. The hydraulic pistons are sealed by seals 49 and pressurized hydraulic oil is introduced through holes 80. This oil extends the pistons fully, thus setting them against the stop formed by the retainer plate 36. Overload beam 50 bears against the pistons 38 and horizontally acting rolling forces are transmitted through the cluster assembly, spacer 69 and overload beam 50 to the pistons. A hydraulic pressure regulator valve (not shown) is provided so that the hydraulic force applied to the pistons 38 is sufficient to support all normal rolling forces. A hydraulic relief valve (not shown) is also provided so that, if the rolling force exceeds a predetermined level (for example, 20% higher than the normal maximum), the relief valve will blow and the pistons 38 will move back to relieve the forces. A limit switch or pressure switch (not shown) will normally be used to sense when this condition occurs in order to warn the mill operator or to stop the mill automatically by electrical interlock. Because of their function, the assemblies consisting of the cylinders and hydraulic pistons 38 and associated parts are known as the overload cylinders.

Spring means (not shown) hold overload beams 50 firmly against pistons 38. Covers 54 are attached to beam 32 by screws 55 and sealed by O-rings 79. The covers 54, together with guide pins 51 sealed by seals 53, form pneumatic cylinders of which the guide pins 51 form the pistons. During rolling, air is introduced through ports 56. When the horizontal rolling force acts in a direction to push over-load beam 50 against pistons 38, the air cylinders have no effect since they are far too weak to overcome rolling forces. When the force acts in the opposite direction, however, (which occurs when the direction of rolling reverses) overload beam 50 is pushed by the air cylinders against the adjacent spacer 69 and support arm assembly and preloads it against the work roll. For this reason, the pneumatic cylinders are called preload cylinders.

Each of the fixed side support beams 34 is similar in construction to side support beams 32, except that no hydraulic overload cylinders are provided in the former. Each beam 34 is recessed to provide space for movable beam 45, known as a preload beam, which is slideably mounted in beam 34 by means of guide pins 51 and bushings 52. The guide pins 51 are press fitted in the preload beam 45 and slide freely in bushings 52. Covers 54 are attached to beam 34 by screws 55 and sealed by O-rings 79. The covers, together with said guide pins sealed by seals 53, form pneumatic cylinders, of which the guide pins 51 form the pistons. When the horizontal rolling force acts in a direction to push preload beam 45 against beam 34, the air cylinders have no effect since they are far too weak to overcome rolling forces. When said force acts in the opposite direction, however, (which occurs when the direction of rolling reverses) preload beam 45 is pushed by the air cylinders against the adjacent spacer 69 and support arm assembly and preloads it against the work roll. For this reason, the pneumatic cylinders are called preload cylinders. Spring means (not shown) hold preload beam 45 firmly against beam 34, but allow the preload beam to move away from beam 34 when the preload cylinders are operated. It would also be possible to operate the preload cylinders with oil instead of air.

When rolling in a left-to-right direction (FIG. 9), the horizontal rolling force components force the work rolls 30 to the left. The upper left preload beam 45 is thus pushed hard against, and is supported by, fixed beam 34. The lower left overload beam 50 is pushed against, and is supported by, lower hydraulic pistons 38. Thus, upper and lower left preload cylinders have no effect. The lower right preload beam 45 and the upper right overload beam 50 are clearly not subjected to the horizontal rolling force components in this case, hence the right preload cylinders operate and guide rods 51 push the upper right overload beam 50 and the lower right preload beam 45 against upper and lower right spacers 69 and support arm assemblies, respectively, and preload the assemblies against upper and lower work rolls 30, respectively.

When rolling in a right-to-left direction (FIG. 9), the horizontal rolling force components force the work rolls to the right. In this case, the lower right preload beam 45 is thus pushed hard against, and is supported by, fixed beam 34. The upper right overload beam 50 is pushed against, and is supported by, upper hydraulic pistons 38. The upper and lower right preload cylinders have no effect. The upper left preload beam 45 and lower left overload beam 50 are clearly not subjected to said horizontal rolling force components in this case, hence the left preload cylinders operate and guide rods 51 push the upper left preload beam 45 and the lower left overload beam 50 against upper and lower left spacers 69 and support arm assemblies, respectively, and preload the assemblies against upper and lower work rolls 30, respectively.

The embodiment shown in FIG. 9 is designed primarily for a reversing mill, as the above description implies. In such a case, it is desirable to have one overload system on the left, and one system, at the right, so that excessive horizontal rolling forces, which generally act towards the entry side of the mill (since the major components of such forces are torque reaction forces, as is well known in the art), can be prevented. It is also always desirable to have one overload system for the upper half of the mill and one for the lower half since, in a mill wreck, the rolled strip may wrap itself around the upper work roll or the lower or jam into any one of the cluster arm assemblies. The embodiment of FIG. 9 satisfies both of these requirements by having overload cylinders at upper right and lower left. Even in a reversing mill, wreck protection will be provided if overload systems for the upper and lower halves of the mill are provided, both located to the same side of the work rolls. Clearly, it would also be possible to satisfy these requirements by having overload cylinders at upper left and lower right (same cost) or at upper and lower left, and upper and lower right (higher cost). Furthermore, for a one-way mill, the above requirements would be met by having overload cylinders mounted at the entry side only. It is also possible, in applications where there is no danger of overload, to provide none of the beam assemblies with overload cylinders. All of these possible arrangements clearly fall within the scope of the present invention.

Operation of the side support beam system is as follows (with reference to FIG. 9). The overload cylinders are provided with pressurized hydraulic oil at all times, even when the mill is stopped. The preload cylinders are only provided with pressurized air when the mill is turning.

When the mill is stationary, the left hand vertical faces of upper right overload beam 50 and lower right preload beam 45 are exactly in line, and the right hand vertical faces of upper left preload beam 45 and lower left overload beam 50 are exactly in line. Because the preload cylinders are not pressurized, upper and lower support arm assemblies 61 are loose and it is possible, provided that the mill screwdown is open, to slide upper and lower work rolls in or out of the mill in order to change rolls. Furthermore, it is possible to slide spacers 69 in or out of the mill in order to change spacers.

When any such roll change or spacer change is completed, the preload cylinders are pressurized (either by manual operator selection or by electrical interlock from an existing control such as the operator's "mill direction" selector). It is usual to provide a higher air pressure in the preload cylinders on one side than on the other. For example, the left side preload cylinders (FIG. 9) may operate at 80 psi and the right side preload cylinders may operate at 60 psi. This is in order to offset both work rolls in the same direction (to the right in the above example) as this ensures that, when the vertical roll separating force is applied by operating the screwdown, the horizontal component of this force arising on the work rolls 30 (due to the small offset of their axes from the vertical center line of the machine) will be minimized. When rolling commences, a horizontal torque reaction force develops on each work roll 30, pushing it towards the entry side of the mill. In the above example, if rolling commences in a right-to-left direction, the torque reaction forces act to force the work rolls 30 to the right (i.e., in the same direction as the initial preload force) and the work rolls 30 remain offset slightly to the right. If rolling commences in a left-to-right direction, the torque reaction forces act to force the work rolls 30 to the left, and the work rolls 30 will both move a very small distance to the left so that rolling continues with the work roll axes offset slightly to the left of the vertical center line of the machine. Regardless of the rolling direction, the preload cylinders will operate to hold those support arm assemblies not subjected to rolling forces tight against the respective work rolls 30.

It will be understood by one skilled in the art that the teachings of this disclosure could be applied to either the upper or lower half only of a six-high mill, the other half of the mill being conventional.

What is claimed is:

1. A fourteen-high rolling mill roll arrangement consisting of an upper and a lower seven-roll cluster, each of said clusters comprising a work roll, an intermediate roll and a back-up roll arranged in the same vertical plane, two side intermediate rolls, one contacting each side of said work roll, and two side back-up rolls, each contacting one of said side intermediate rolls, said intermediate roll and said back-up roll for each cluster being mounted in chocks, said work roll floating freely in said cluster, said side intermediate rolls being mounted in chocks, and said side back-up rolls each comprising several rollers rotatably mounted upon a stationary shaft, each of said side back-up roll shafts being mounted in and supported at intervals through its length by an adjustable stationary rigid support beam assembly, each of said adjustable rigid support beam assemblies comprising a support arm affixed by pivot means at its ends to the chocks of the adjacent one of said intermediate rolls, said support arm mounting the chocks of its respective side intermediate roll and the shaft of its respective side back-up rollers, a spacer in association with each of said support arms to adjust the horizontal position thereof to control clearances between said work rolls, said side intermediate rolls and said back-up rolls, and a stationary side support beam in association with each of said support arms to give rigid support to its respective support arm and spacer thereof, said mill having a pair of mill housings, each of said stationary side support beams extending between and being mounted on said mill housings, and means to adjust each support arm vertically to adjust the position of the axes of each side intermediate roll and its adjacent side back-up roll until said axes and the axis of the adjacent work roll all lie substantially in one plane, whereby to minimize bending forces on said side intermediate rolls.

2. A rolling mill according to claim 1 wherein each of said stationary side support beams comprises a movable beam guidably mounted on a rigid stationary spacer beam mounted between said two housings of said mill, overload prevention means mounted on said spacer beam for setting the horizontal working position of said movable beam, and for limiting the horizontal rolling force component that said overload prevention means will support when said force component acts towards said overload prevention means, and cylinder means to push the adjacent support arm towards the adjacent work roll in order to take out the clearance between said side intermediate roll of said support arm and the adjacent work roll when said force component acts away from said overload prevention means.

3. A rolling mill according to claim 1 wherein one of said stationary side support beams to one side of one of said work rolls and one of said stationary side support beams to the other side of the other of said work rolls each comprises a movable beam guidably mounted on a rigid stationary spacer beam mounted between said two housings of said mill, overload prevention means mounted on said spacer beam for setting the horizontal working position of said movable beam, and for limiting the horizontal rolling force component that said overload prevention means will support, when said force components act towards said overload prevention means, and cylinder means to push the adjacent support arm towards the adjacent work roll in order to take out the clearance between said side intermediate roll of said support arm and the adjacent work roll when said force component acts away from said overload prevention means, the remaining ones of said stationary side support beam assemblies each comprising a movable beam guidably mounted on a rigid stationary spacer beam mounted between said two housings of said mill, and cylinder means to push the adjacent support arm towards the adjacent work roll in order to take out the clearance between said side intermediate roll of said support arm and the adjacent work roll when the horizontal rolling force component acts away from said last mentioned spacer beam.

4. A rolling mill according to claim 1 wherein said stationary side support beams to one side of said work rolls each comprises a movable beam guidably mounted on a rigid stationary spacer beam mounted between said two housings of said mill, overload prevention means mounted on said spacer beam for setting the horizontal working position of said movable beam, and for limiting the horizontal rolling force component that said overload prevention means will support when said force component acts towards said overload prevention means, said stationary side support beams on the other side of said work rolls each comprising a movable beam guidably mounted on a rigid stationary spacer beam mounted between said two housings of said mill, and cylinder means to push the adjacent support arm towards the adjacent work roll in order to take out the clearance between said side intermediate roll of said support arm and the adjacent work roll when the horizontal rolling force component acts away from said last mentioned spacer beam.

5. A rolling mill according to claim 1 wherein said stationary side support beams each comprises a movable beam guidably mounted on a rigid stationary spacer beam mounted between said two housings of said mill, and cylinder means to push the adjacent support arm towards the adjacent work roll in order to take out the clearance between said side intermediate roll of said support arm and the adjacent work roll when the horizontal rolling force component acts away from said spacer beam.

6. A rolling mill according to claim 1 wherein said pivot means affixing the ends of said support arm to said intermediate roll chocks incorporate eccentric means whereby rotational adjustment of said pivot means vertically adjusts said position of the axes of said side intermediate roll and its adjacent side back-up roll, until said axes and the axis of said adjacent work roll all lie substantially in one plane.

7. A fourteen-high rolling mill roll arrangement consisting of an upper and a lower seven-roll cluster, each of said clusters comprising a work roll, an intermediate roll and a back-up roll arranged in the same vertical plane, two side intermediate rolls, one contacting each side of said work roll, and a pair of side back-up rolls, each contacting one of said side intermediate rolls, said intermediate roll and said back-up roll of each cluster being mounted in chocks, said work roll floating freely in its cluster, said side intermediate rolls being mounted in chocks and said side back-up rolls each comprising several rollers rotatively mounted upon a stationary shaft, ech of said side back-up roll shafts being mounted in and supported at intervals through its length by an adjustable rigid stationary support beam assembly, means in association with each of said adjustable stationary rigid support beam assemblies for adjustment of said assemblies horizontally, to control clearances between said work rolls, said side intermediate rolls and said side back-up rolls, and separate eccentric means in association with each of said adjustable stationary rigid support beam assemblies for adjustment of said assemblies vertically, to adjust the position of the axes of each side intermediate roll and its adjacent side back-up roll until said axes and the axis of said adjacent work roll all lie substantially in one plane, in order to minimize bending forces on said side intermediate roll, said separate horizontal and vertical adjustments accommodating varying sizes of rolls within each cluster.

* * * * *

UNITED STATES PATENT AND TRADEMARK OFFICE

CERTIFICATE OF CORRECTION

PATENT NO. : 4,462,236

DATED : July 31, 1984

INVENTOR(S) : John W. Turley, et al.

It is certified that error appears in the above-identified patent and that said Letters Patent is hereby corrected as shown below:

The title page should be deleted to appear as per attached title page.

Signed and Sealed this

*Sixteenth* Day of *July 1985*

[SEAL]

*Attest:*

DONALD J. QUIGG

*Attesting Officer* *Acting Commissioner of Patents and Trademarks*

UNITED STATES PATENT AND TRADEMARK OFFICE

CERTIFICATE OF CORRECTION

PATENT NO. : 4,462,236

DATED : July 31, 1984

INVENTOR(S) : John W. Turley, et al.

It is certified that error appears in the above—identified patent and that said Letters Patent is hereby corrected as shown below:

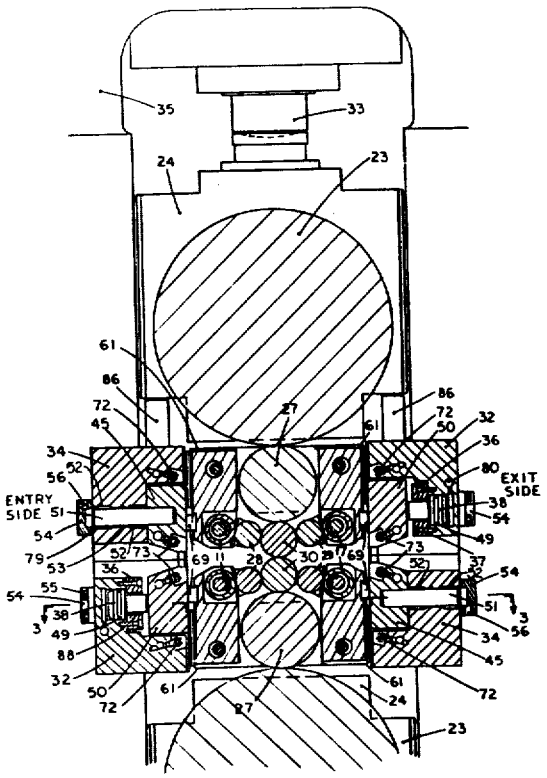

On the informational first page, the drawing should be: